United States Patent [19]

Martin et al.

[11] Patent Number: 5,054,757

[45] Date of Patent: Oct. 8, 1991

[54] MECHANISM AND METHOD FOR ACCUMULATING AND FOLDING SHEETS

[76] Inventors: Samuel W. Martin, Martin Rd., Weston, Conn. 06883; Carl A. Miller, 641 Jennings Rd., Fairfield, Conn. 06430; William V. Pickering, Jr., 15 Hillside Ave., New Canaan, Conn. 06840; Steven A. Supron, 11 Comstock Hill Ave., Norwalk, Conn. 06850; David Murcko, deceased, late of Sandy Hook, Conn.; by Linda Murcko, administrator, 57 Tody Hill Rd., Sandy Hook, both of Conn. 06481

[21] Appl. No.: 491,881

[22] Filed: Mar. 12, 1990

[51] Int. Cl.[5] ..... B42C 1/00

[52] U.S. Cl. ..... 270/45; 270/51; 493/420

[58] Field of Search ..... 270/45, 46, 47, 51, 270/32; 493/419, 420

[56] References Cited

U.S. PATENT DOCUMENTS

| | | | |
|---|---|---|---|
| 3,265,382 | 8/1966 | Sherman | 270/45 |
| 3,336,726 | 8/1967 | Mayer | 270/45 |
| 3,510,122 | 5/1970 | Gavaghan | 270/68 |
| 3,627,305 | 12/1971 | Heigl et al. | 270/68 A |
| 3,975,009 | 8/1976 | Brown | 270/68 A |
| 4,014,535 | 3/1977 | Kleid et al. | 270/19 |
| 4,101,121 | 7/1978 | Rastorguyeff | 270/68 A |
| 4,202,621 | 5/1980 | Yoshimura et al. | 355/14 R |
| 4,300,756 | 11/1981 | Danchak, Jr. et al. | 271/8 R |
| 4,541,764 | 9/1985 | Govan et al. | 414/52 |
| 4,573,672 | 3/1986 | Lehmann et al. | 270/45 |
| 4,589,650 | 5/1986 | Miyoshi | 271/242 |
| 4,621,802 | 11/1986 | Ishida et al. | 271/272 |
| 4,621,966 | 11/1986 | Luperti et al. | 414/43 |
| 4,668,212 | 5/1987 | Kotani | 493/216 |
| 4,678,178 | 7/1987 | Akiyama et al. | 271/242 |
| 4,694,632 | 9/1987 | Gunther, Jr. | 53/55 |
| 4,701,155 | 10/1987 | Ott | 493/14 |
| 4,701,233 | 10/1987 | Beck et al. | 156/217 |
| 4,717,134 | 1/1988 | Iida | 270/45 |
| 4,834,699 | 5/1989 | Martin | 493/421 |
| 4,900,391 | 2/1990 | Mandel et al. | 156/364 |

FOREIGN PATENT DOCUMENTS

| | | | |
|---|---|---|---|
| 232372 | 11/1985 | Japan | 270/45 |
| 197366 | 9/1986 | Japan | 270/45 |

*Primary Examiner*—Edward K. Look
*Assistant Examiner*—Therese M. Newholm
*Attorney, Agent, or Firm*—Robert H. Whisker; Melvin J. Scolnick; David E. Pitchenik

[57] ABSTRACT

An apparatus for producing items in selected configurations and a system and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on printed sheets and envelope forms. The data processor also controls the laser printer to print an address for the mail piece either on an envelope form or on a printed sheet in a position where it will be visible through the envelope. Thus the apparatus is controlled to process an output file stored in the data processor into a mail run having a selected configuration. A mechanism and method for accumulating and folding sheets is also disclosed.

26 Claims, 7 Drawing Sheets

MECHANISM AND METHOD FOR ACCUMULATING AND FOLDING SHEETS

BACKGROUND OF THE INVENTION

This invention relates to the production of item comprising accumulations of folded sheets, particularly mail pieces. More particularly, it relates to a mechanism for accumulating and folding sheets.

Self-mailers are mail pieces which are produced from pre-cut forms which are folded and sealed to form a mail piece, and are well known, as is apparatus for printing and forming such self-mailers. Commonly assigned, co-pending U.S. Application, Ser. No. 407,583, to: Samuel W. Martin, filed Sept. 14, 1989 (C-574) discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sept. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted pieces or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts.) At most, like Huffman they may provide for an ability to insert "stuffers". Further, with the exception of the above mentioned U.S. Application, Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe accumulated with the control document and at the last station the entire accumulation is inserted in a preformed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Braneky et al.; For: Process and Apparatus for Controlling Document Feeding Machines From Indicia Contained on a Document Fed Therefrom; issued: Jan. 27, 1976.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

The major steps in forming a mail piece involve folding to an appropriate size an accumulation of the various elements of the mail piece, and enclosing the sheets comprised in the mail form within an envelope. This enclosing step has normally been carried out by inserter systems such as those discussed above, though systems such a the PPHE which wrap sheets in an envelope form are also known. In either case, however, prior art systems have generally provided separate mechanisms for folding operations and for accumulation operations, with the result that prior art systems have generally been large and expensive.

Typical of such systems are those shown in U.S. Pat. Nos. 4,014,535 to: Klied et al. and U.S. Pat. No. 4,022,457 to: Mavin et al., which disclose the accumulator and folder mechanisms for the PPHE, respectively. In U.S. Pat. No. 4,014,535 a rotating cylinder with its circumference equal to a predetermined sheet length is provided. A printed web is wrapped around the cylinder a predetermined number of times and the resulting spiral is cut with a single stroke to produce the desired number of sheets. U.S. Pat. No. 4,022,457 shows the 'plow' folding mechanism which longitudinally folded the resulting accumulation. At least partly as a result of this approach systems such as the PPHE were large and expensive and not suited for an office environment.

Thus it is an object of the subject invention to provide a simple, and compact mechanism for accumulating and folding the elements of a mail piece.

BRIEF SUMMARY OF THE INVENTION

The above objects are achieved and the disadvantages of the prior art are overcome in accordance with the subject invention by means of a mechanism and method which includes an apparatus for folding an accumulation of sheets, which apparatus further includes a motor or the like for activating the apparatus and a pair of intake rollers. The mechanism also includes apparatus for urging a plurality of sheets into the nip of the intake rollers while the intake rollers are inoperative to capture the sheets, so that the accumulation is formed in the nip. When the accumulation is formed the motor activates the folding apparatus to fold the accumulation.

In accordance with one aspect of the subject invention the accumulator folder mechanism further includes a diverter for diverting the accumulation so that it passes through the mechanism without folding.

In accordance with a second aspect of the subject invention the folding apparatus includes a buckle chute and a cooperating pair of fold rollers to fold the accumulation along a predetermined line.

In accordance with another aspect of the subject invention the mechanism includes an apparatus for selectively altering the operation of the buckle chute so that the accumulation is folded along another line.

In accordance with another aspect of the subject invention the intake rollers are activated in one direction as the accumulation is formed and then in the opposite direction to capture the accumulation.

Thus it can be seen that the subject invention advantageously achieves the above objects. Other embodiments and advantages of the subject invention will be readily apparent to those skilled in the art from consideration of the attached drawings and the Detailed Description set forth below.

BRIEF DESCRIPTIONS OF THE DRAWINGS

DETAILED DESCRIPTION OF PREFERRED EMBODIMENTS OF THE SUBJECT INVENTION

Figure 1:
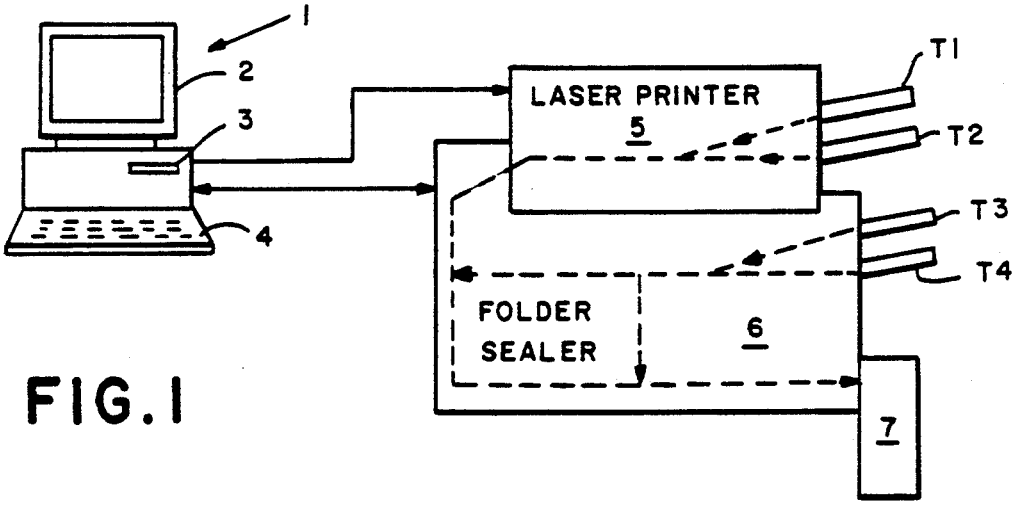
FIG. 1 shows a schematic block diagram of apparatus in which the mechanism of the subject invention may be used.

FIG. 1 shows a system for producing mail pieces and with which the mechanism of the subject invention may be used. The system includes a personal computer 1 including a monitor 2, a hard disk 3 with a minimum of one megabyte of available storage, and a keyboard 4. Computer 1 also requires a minimum of 640 K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 is used for printed, non-window envelope forms, and tray T2 may be used for either three-thirds or two-thirds length sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Figure 2:
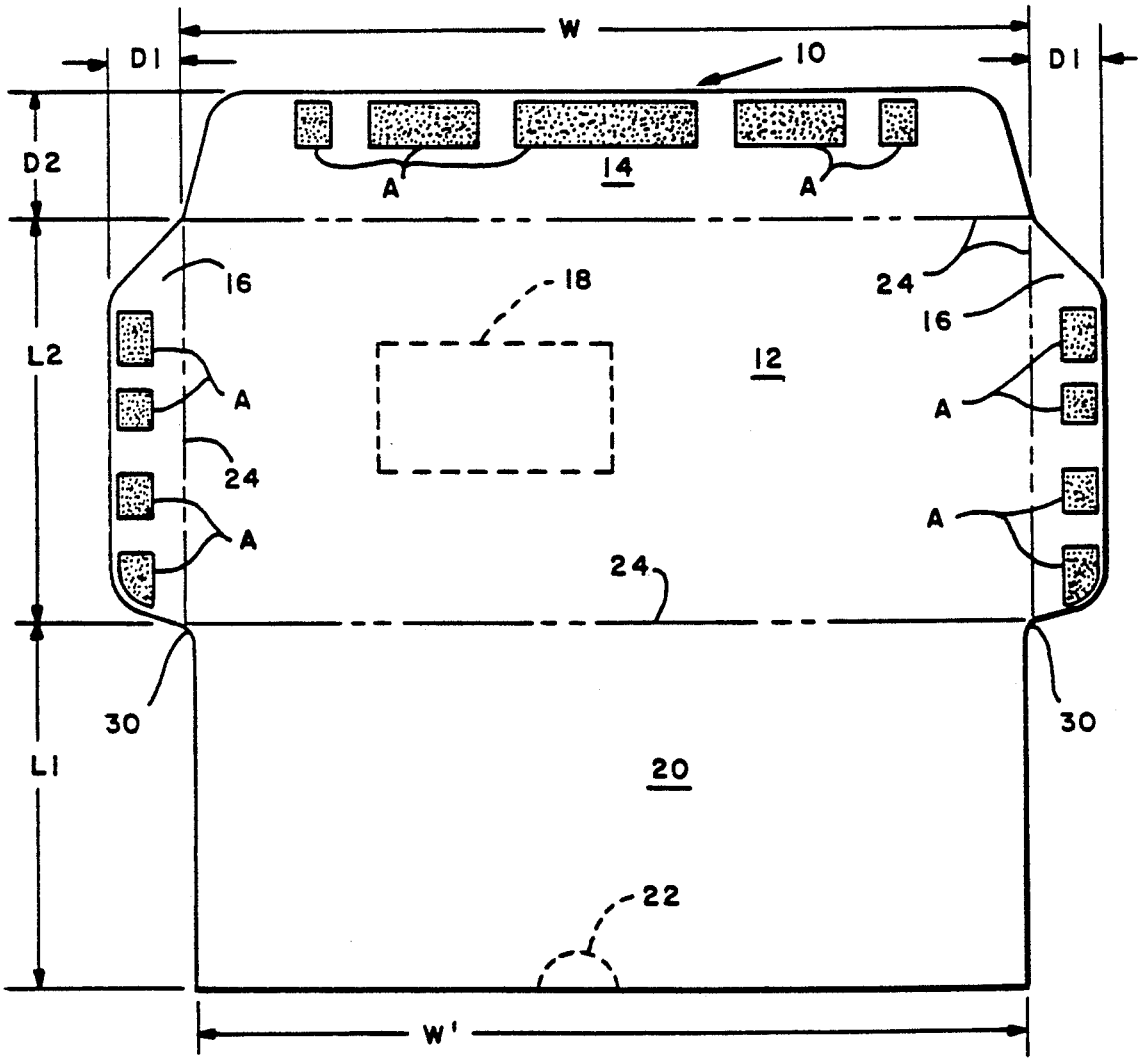
FIG. 2 shows a plan view of an envelope form suitable for use with the apparatus of FIG. 1.

FIG. 2 shows a unique envelope form, which is designed to function optimally with the apparatus of the subject invention. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A so that the rollers will not be contaminated by adhesive A when it is moistened prior to sealing and, also, to reduce curling of the form. Adhesive A is preferably a remoistenable adhesive (such as 0.0006 to 0.001 inches of dextrin/resin adhesive) which is moistened for sealing as will be described further below, but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines parallel to and outwards of lines 24 to allow for mail pieces having a maximum thickness and lower panel 20 may be provided with a notch 22 to facilitate removal of the sheets when the mail piece is opened.

Form 10 is designed for optimal performance with the mechanism of the subject invention. The width W of upper panel 12 is chosen to be slightly greater than the width of the sheets to be used in the mail piece and the length L1 of lower panel 20 is chosen to be approximately equal to one-third the length of a full size sheet to be used with the mail piece. The length L2 of panel 12 is chosen to be substantially greater than length L1 to allow for increase tolerance in positioning these sheets on form 10. The width W' of lower panel 20 is equal to the width of the sheets to be used in the mail piece. By providing width W' equal to the width of the sheets automatic centering guides may be used to center the sheets with respect to form 10 before it is folded as will be described further below. Further, a narrower lower panel 20 allows greater skew tolerance in folding the lower panel, and aids in enveloping the contents of thicker mail pieces by permitting side flaps 16 to wrap more gradually about the mail piece.

Because lower panel 20 is substantially shorter than upper panel 12 the width D of side flaps 16 and length D2 of upper flap 14 are chosen to be sufficient to assure that the sealed mail piece completely encloses these sheets. Upper flap 14 is also formed to be substantially rectangular to assure that the envelope is closed across its full width, and lower panel 20 is provided with bevels 30 so that it flares to the full width of upper panel 12 to assure that the lower corners of the completed mail piece are closed. It should also be noted that adhesive A on side flap 16 is applied so that it extends no further than lower panel 20 when the envelope is folded and does not come into contact with the sheets within the mail piece.

For a standard $8\frac{1}{2}\times 11$ size three-thirds sheet the following approximate dimensions have been found to be satisfactory for form 10.

Figure 3:
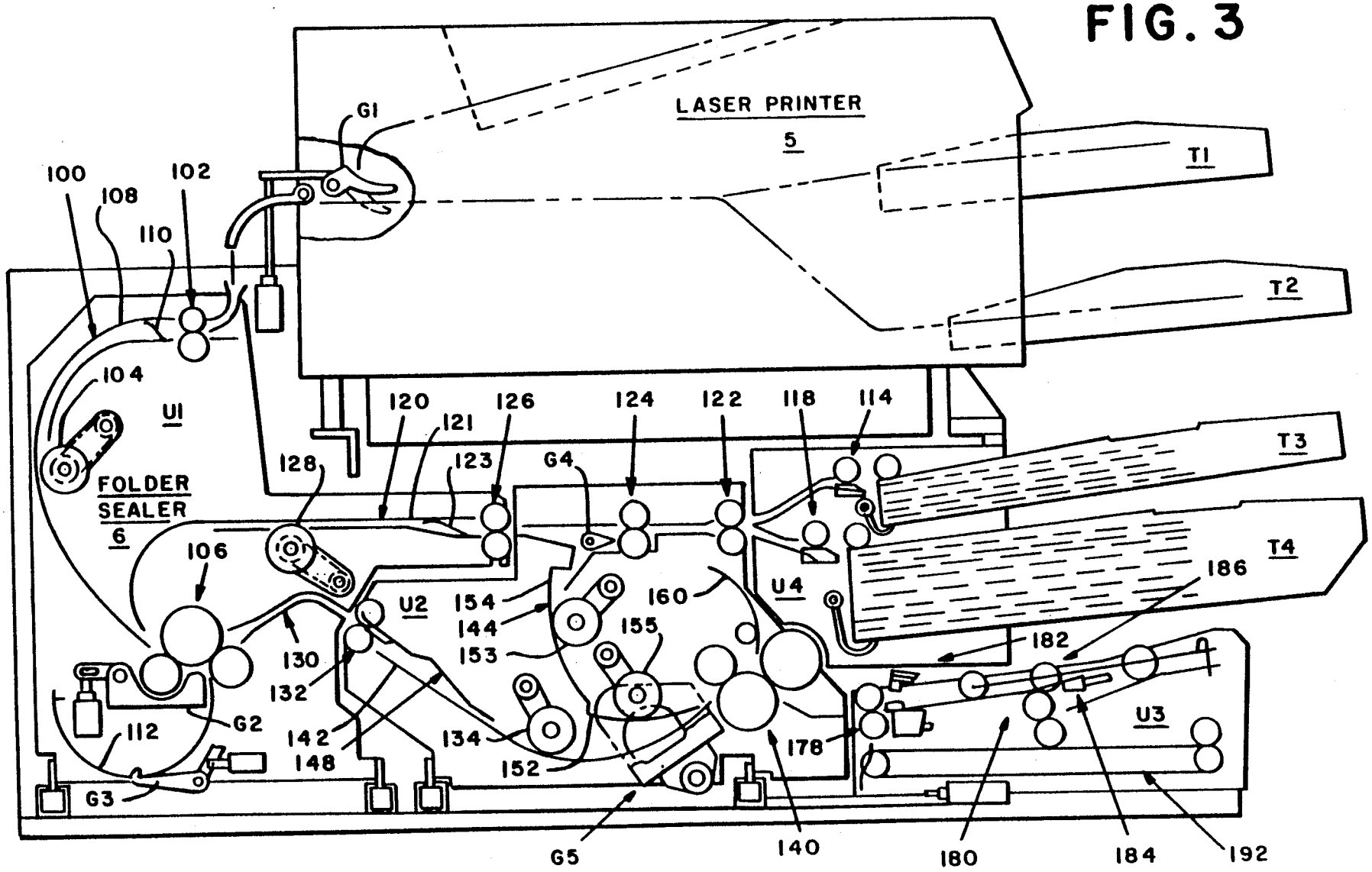
FIG. 3 shows a semi-schematic side view of a printer and a folder sealer apparatus in which the mechanism of the subject invention may be used.

D1=0.75 inches
D2=1.31 inches
L1=3.75 inches
L2=4.13 inches
W=8.70 inches
W'=8.50 inches Turning now to FIG. 3 a semi-schematic side view of folder sealer 6 is shown. As a printed envelope form 10 or a printed sheet exit laser printer 5 they are driven along guides 100 by roller pair 102 and then urged into the nip of accumulator folder 106 by urge roller 104. (As used herein a sheet is "urged" when it is moved by an "urge roller" constructed to slip or stall on the sheet before the sheet will buckle under the load. This contrasts with sheets which are driven by a roller pair in a positive manner, substantially without slipping.) Normally the first item will be an envelope form 10 and gate G2 will be in the activated (closed) state diverting form 10 for further processing as will be described further below. Normally following items will be printed sheets and motor Ml (shown in FIG. 6), which drives folder accumulator assembly 106 will be stopped (or rotating in a reverse direction) and the sheets will be driven into the nip of assembly 106 by urge roller 104, which will continue to rotate. Because guide 100 is curved to increase the stiffness of the sheets urge roller 104 will slip on the sheet as it is driven into the nip of assembly 106 before the sheets will buckle. Relief 108 and spring 110 are provided in guide 100 , so that the tail of any three-third sheets is held clear of roller pair 102 so that following printed sheets may be accumulated in the nip of assembly 106.

If the sheets accumulated in the nip of assembly 106 include a three-thirds sheet gate G2 is deactivated (open) and motor Ml is started and the accumulated sheets are driven into curved, open, one sided buckle chute 112. Such chutes are described in U.S. Pat. No. 4,394,699 to: Martin, the disclosure of which is hereby incorporated by reference.

If the sheets to be printed have a significant curl it may prove necessary or desirable to use conventional curved buckle chutes or to provide some other means of controlling the folding of curled sheets predisposed to fold in the wrong direction.

The accumulated sheets are folded by assembly 106 to a two-thirds length and exit assembly 106 for further accumulation with the previously passed form 10. Gate G3 may be activated for a "Z" fold (normally used with a window envelope); as will be described further below.

Alternatively a window envelope or pre-printed sheets, of three-thirds length, may be fed from trays T3 or T4 by feeder assemblies 114 or 118 and, with gate G4 deactivated, driven along curved guides 120 by roller pairs 122, 124, and 126 and urged by urge roller 128 for processing by accumulator folder assembly 106 in the same manner as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the accumulated sheets is moved along guides 130 by roller pair 132 and urge roller 134 until it is driven into the nip of accumulator folder assembly 140. Motor M2, which drives assembly 140 is off (or, possibly, running in reverse) and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 and spring 144 operate together as described above so that the accumulated sheets will clear form 10 and progress to the nip of assembly 140.

Since laser printer 5 will normally have a feed path designed for a conventional paper size (e.g. approximately $8\frac{1}{2}$") envelope form 10, when fed through printer 5, is fed with flaps 16 folded into the closed position. Accordingly, an opening mechanism 148 is provided along path 130 to open flaps 16 before form 10 is accumulated with the following sheets.

Lateral guides G5 are provided to assure that the sheets are centered with panel 20 of form 10.

If two-thirds sheets, one-third sheets, or BRE's are fed from trays T3 or T4 along guides !20 gate G4 is activated and these sheets are diverted to guides 144. The diverted sheets are urged by urge rollers 146 and 148 into the nip of assembly 140 and ar accumulated in the manner described above in the nip of assembly 140 with the previously processed envelope form 10 and, any pre-folded printed or pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140, is started and drives the completed accumulation into buckle chute 160 so that the completed accumulation is folded about fold line 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed, by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 or M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles. (While stepper motors have proven adequate other motor types, such as conventional brushless d.c. gear motors, which have better low speed torque characteristics, are within the contemplation of the subject invention and may prove preferable.)

Figure 4:
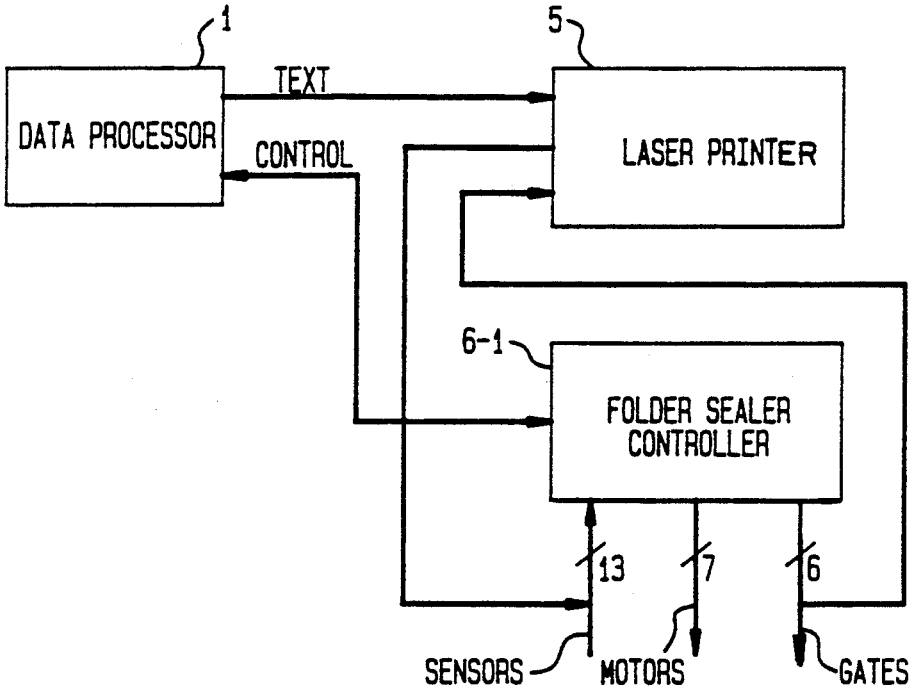
FIG. 4 shows a schematic block diagram of the flow of control and text information signals in the apparatus of FIG. 1.

Turning to FIG. 4 the control architecture for the system of the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1 which includes an integrated circuit microcontroller, which is preferably a model 80C196KB manufactured by the Intel Corporation of California. As will be described below controller 6-1 receives data structures defining the configuration for mail pieces in a given mail run from data processor 1, as well as specific information for each mail piece, such as ID numbers and variable numbers of printed sheets to be included in the mail piece. Controller 6-1 than controls devices, (i.e. sensors, motors, and gates) in folder sealer 6 to produce mail pieces in accordance with the data structures and specific mail piece information. As can be seen in FIG. 4, minor modifications, easily within the skill in the art have been made to laser printer 5 to allow controller 6-1 to read sensors S1, S2, and S3 provided in laser printer 5 and control gate G1 which is also part of laser printer 5.

Figure 5:
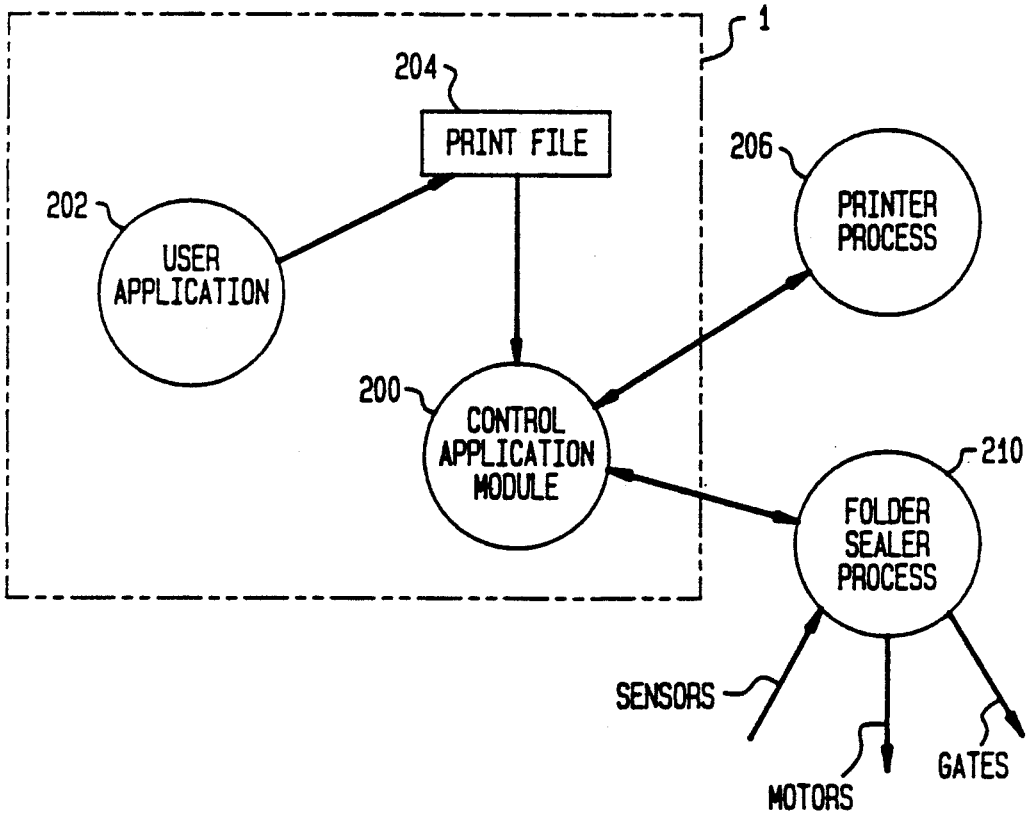
FIG. 5 shows a data flow diagram for the apparatus of FIG. 1.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional manner, and a conventional, serial communications driver to communicate with folder sealer process 210, which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the User Application 202 and having a configuration in accordance with the data structures and specific mail piece information; as will be described further below.

Figure 6:
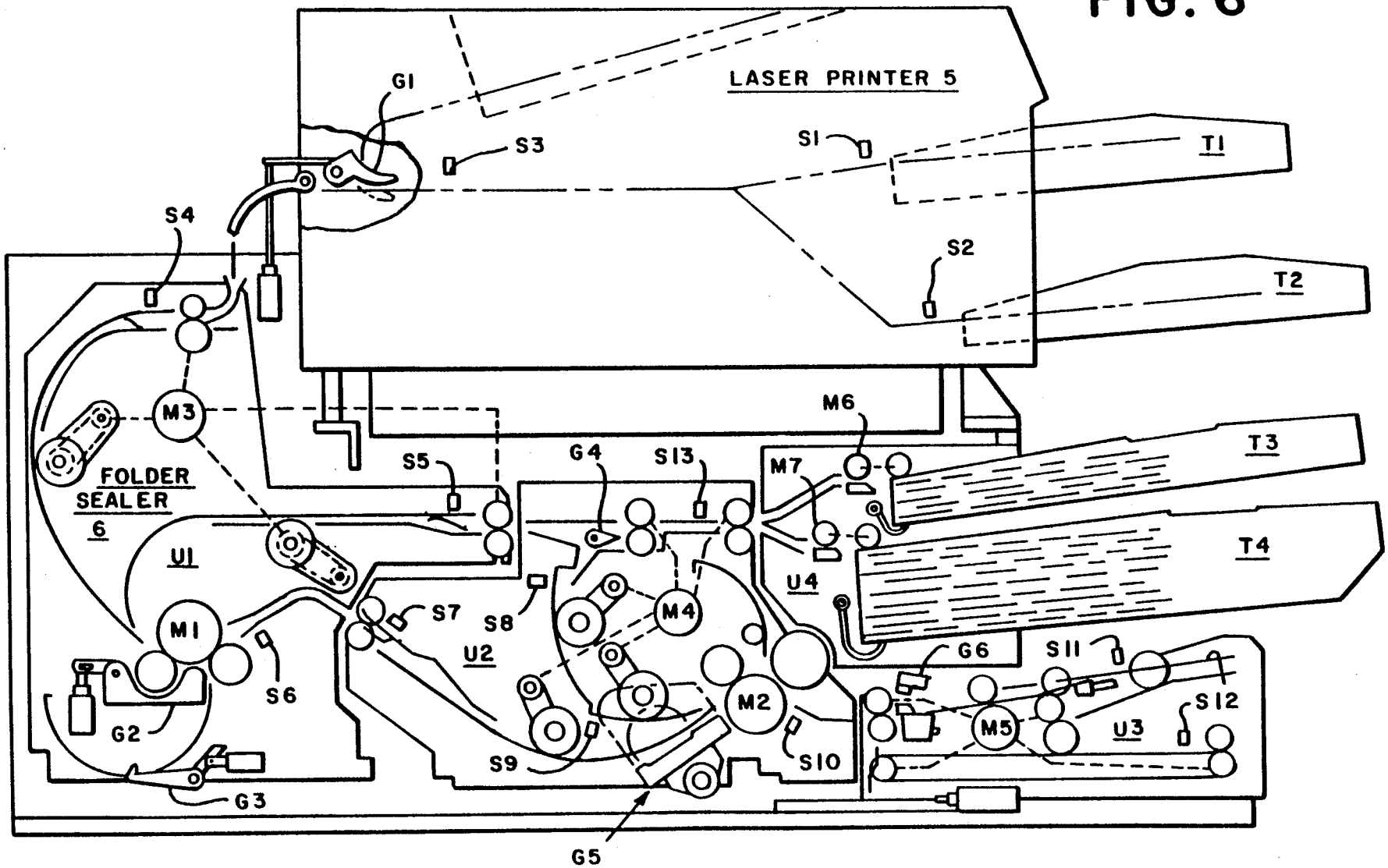
FIG. 6 shows the view of FIG. 3 showing the relationships of sensors, gates, and motors used in FIG. 1 and including those comprised in mechanisms in accordance with the subject invention.

FIG. 6 is a schematic diagram of the sensors, motors and gates used in the prefer embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheets after printing. Gate G1 is a mechanical gate, also part of laser printer 5, which diverts sheets for output on top of laser printer 5, and as noted, has been modified so that it operates under control of controller 6-1 Sensor S4 is an optical sensor provided in folder sealer 5 to detect passage of a printed sheet from laser printer 5 to folder sealer 6 along guide 100. Sensor S5 is an optical sensor which detects the presence of pre-printed sheets on guide 120 downstream of gate G4. Sensor S6 detects the presence of sheets output from folder sealer assembly 106 on guide !30, and sensor S7 detects the presence of sheets accumulated in the nip of accumulator folder assembly 140. Sensors S8 and S9 detect the presence of two-thirds and one-thirds sheets, respectively, which have been diverted from guide 120 by gate G4 to accumulator apparatus 140. Sensor S10 is an optical sensor which detects the presence of a folded envelope form 10 and accumulated sheets output from assembly 140 and sensor S11 is an optical sensor which detects the presence form 10 and the accumulated sheets in trailing flap folder sealer 180. Sensor S12 is an optical sensor which detects the output of a folded and sealed mail piece. Sensor S13 is an optical sensor which detects the presence of pre-printed sheets on guide 120 upstream from gate G4.

Gate G1 diverts sheets after printing for output at the top of laser printer 5 so that laser printer 5 may be used as a conventional computer output line printer without printed sheets passing through folder sealer 6, and also to facilitate recovery from jam conditions. When activated gate G2 diverts envelope form 10 and two-thirds length printed sheets through apparatus 106 without folding. When activated gate G3 effectively shortens the length of buckle chute 112 so that sheets accumulated for folding by apparatus 106 are ultimately folded in a "Z" fold, and when deactivated allows the full length of the accumulated sheets into buckle chute 112 so that these sheets are ultimately folded in a "C" fold. Gate G4 when activated diverts pre-printed two-thirds and one-thirds length sheets and BRE's from guide 120 to guide 144 for accumulation at accumulator folder apparatus 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is part of moistener 182 which moistens adhesive A on flap 14 of form 10 as it enters trailing flap folder sealer 180. Gates G1–G6 are each operated individually under direct control of controller 6-1.

Motors M1 and M2 operate accumulator folder assemblies 106 and 140 respectively. Motor M3 operates urge rollers 104 and 128, and roller pairs 102 and 126, and motor M4 operates urge rollers 153 and 155 and roller pairs 122, 124, and 132 (all shown in FIG. 3).

Motor M5 operates flap folder sealer 180 and motors M6 and M7 feed pre-printed sheets from trays T3 and T4, respectively. Motors M1 through M7 are each operated individually under the direct control of controller 6-1.

Figure 7A:
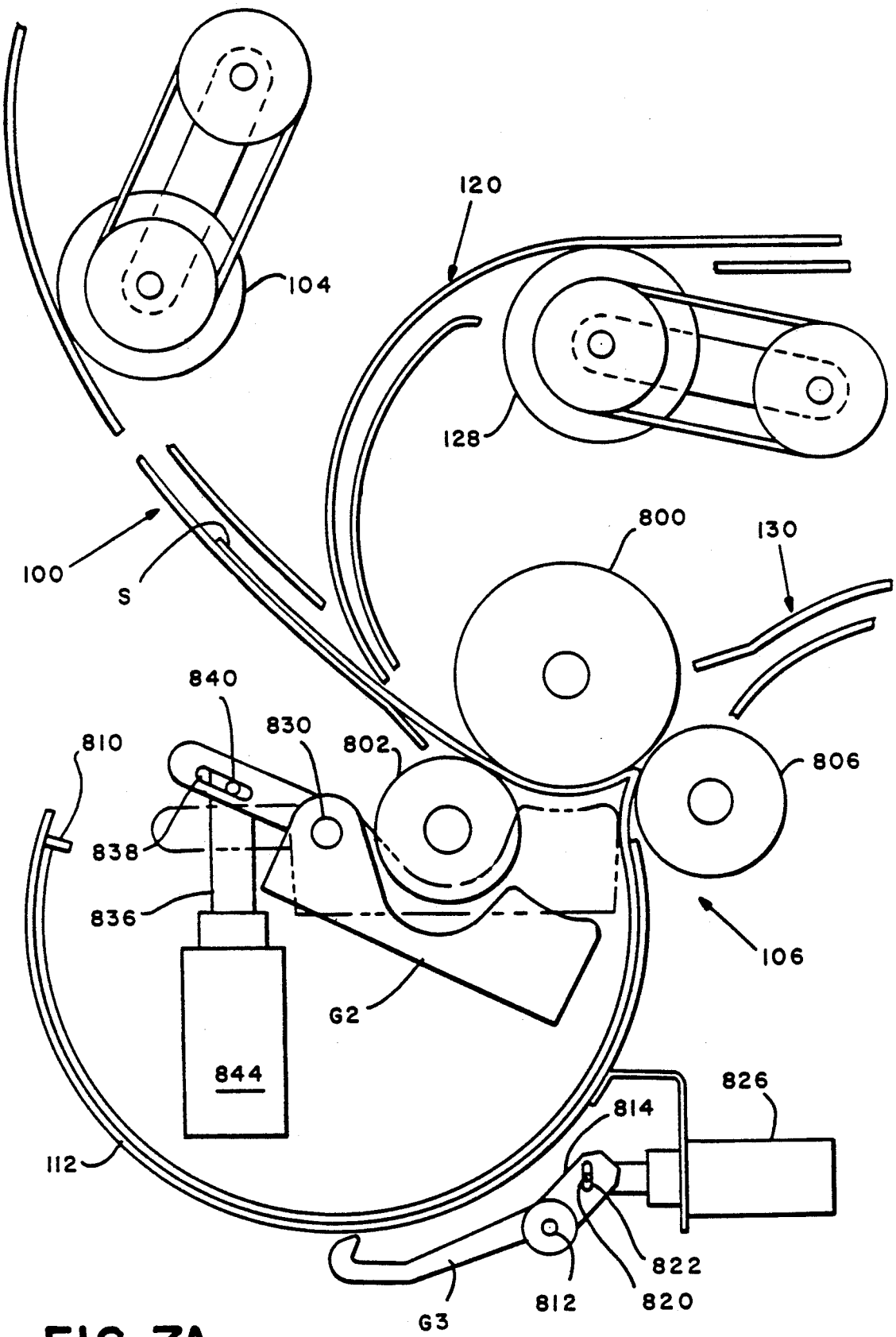
FIGS. 7A and 7B show a mechanism in accordance with the subject invention.
Figure 7B:
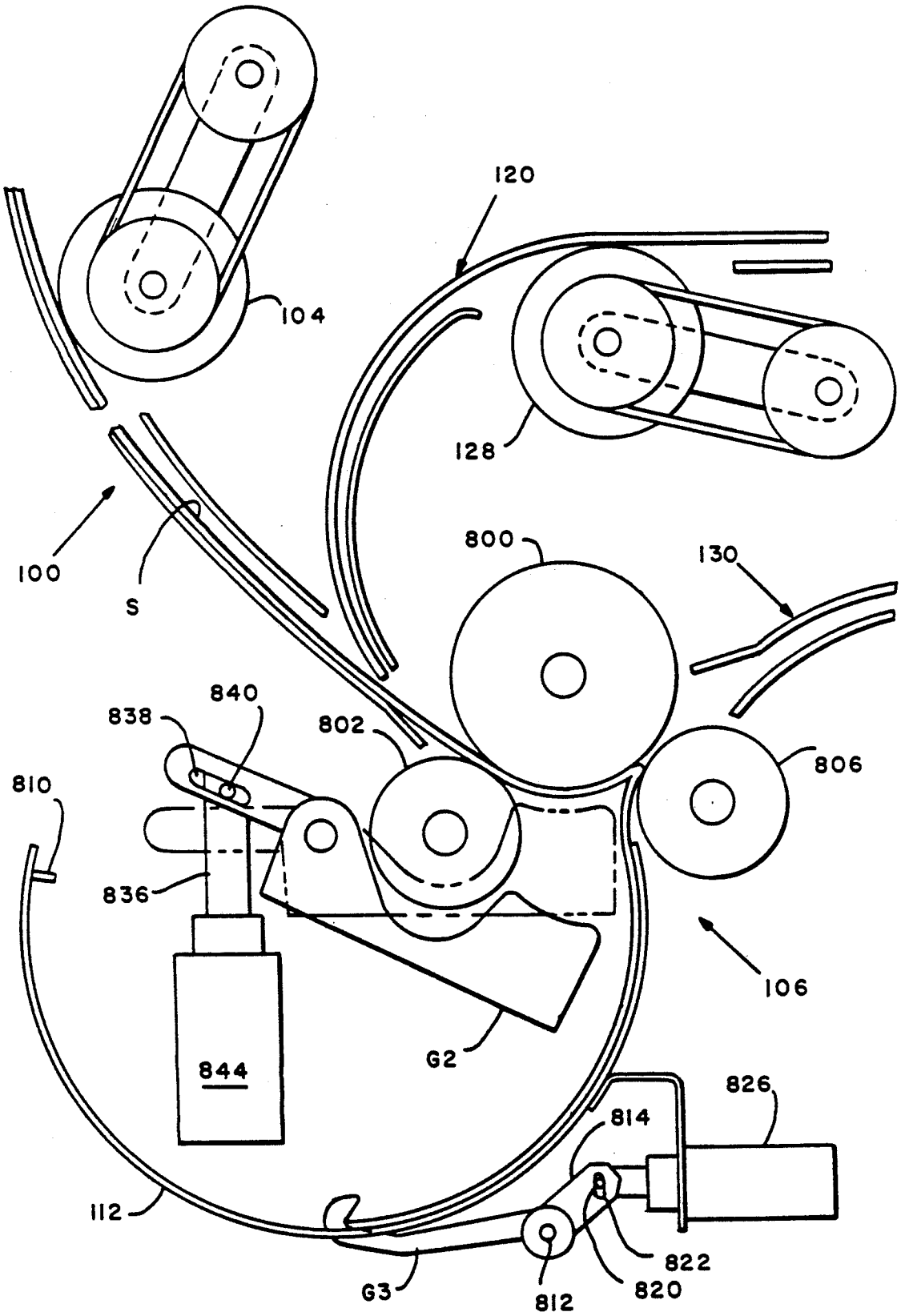

Turning now to FIGS. 7A and 7B a preferred mechanism for accumulating and folding sheets used to accumulate sheets for a mail piece and, if necessary, fold the accumulation from three-thirds to two-thirds length is shown. Accumulator folder assembly 106 includes a driven roller 300, which is driven by motor M1 (shown in FIG. 6), which is a stepper motor driven in accordance with a predetermined velocity profile, as will be described further below. Roller 300 and idler roller 302 form an intake roller pair. Sheets from printer 5 are successively urged along guide 100 by urge roller 104 into the nip of rollers 300 and 302 to form an accumulation. Alternatively, preprinted sheets may be urged along guide 120 by urge roller 128 into the nip. The degree of force applied before slipping is chosen to be sufficient to align the leading edges of the accumulation without buckling the sheets. During the period that the accumulation is formed rollers 300 and 302 are not operated to capture and intake these sheets, and may be operated in a reverse direction so that sheets will not bind in the nip but will be driven against it by rollers 104 and 128 so that the leading edges of the sheets align parallel to the axes of rollers 300 and 302. Guides 100 and 120 are curved to increase the columnar strength of the sheets as they are urged into the nip rollers 300 and 302.

Once any holding time has elapsed assembly 106 is activated and the accumulation is fed into buckle chute 112. In FIG. 7A the accumulation, shown for convenience as a single sheet S, is driven along chute 112 until it reaches stop 810. In an embodiment of the subject invention chute 112 is a curved, one-sided buckle chute as described in U.S. Pat. No. 834,699. Once sheet S reaches stop 810 it buckles and it is capture by a pair of fold rollers consisting of driven roller 800 and idler roller 806. Rollers 800 and 806 then fold sheet S in a convention manner and urge it along guides 130 for further processing.

Figure 8A:
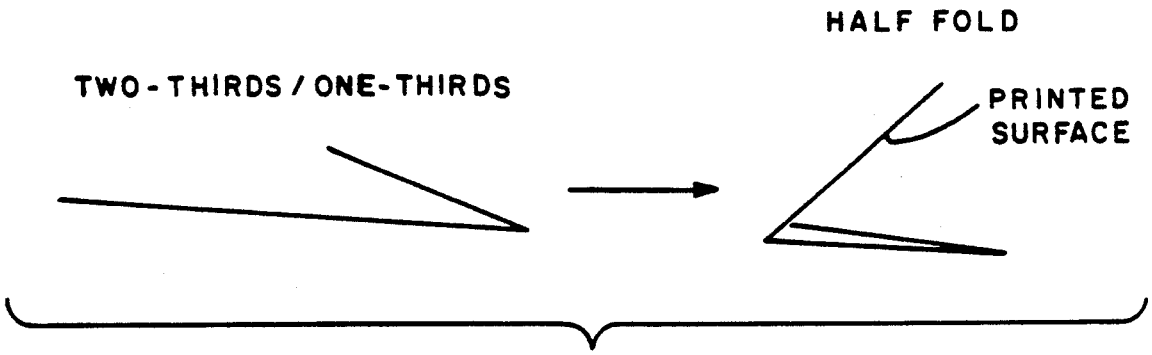
FIGS. 8A and 8B show a three thirds sheet in "C" and "Z" folds respectively.

In FIG. 7A stop 810 is positioned so that sheet S is folded two-thirds/one-thirds as shown in FIG. 8A. As further shown in FIG. 8A a further half fold from two-thirds to one-thirds produces a "C" fold, which is conventional for business letters.

Figure 8B:
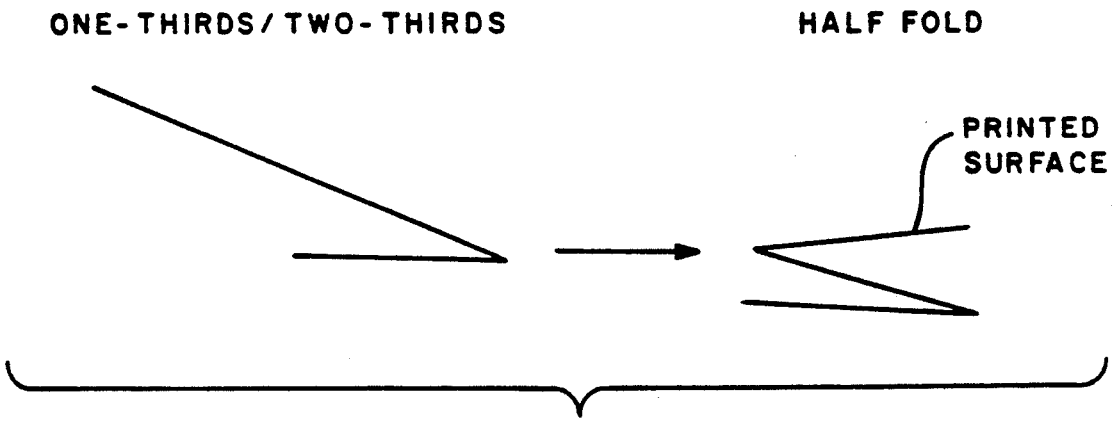

The mechanism of FIGS. 7A and 7B also includes gate G3 for selectively altering the fold geometry. Gate G3 is mounted on pivot 812 so that it may be rotated by arm 8!4 which is connected to actuator 818 by pin 820 and mounting slot 822. As shown in FIG. 8B when solenoid 826 is energized actuator 818 retracts and gate G3 pivots into the path of the sheet S through a slot 828 provided in buckle chute 112. Sheet S is thus stopped before it reaches stop 310 and is folded, as shown in FIG. 8B one-thirds/two-thirds. Thus, a half fold from two-thirds to one-thirds produces a "Z" fold which is useful with window envelopes since the printed surface of sheet S, which is the side distal to buckle chute 112, is exposed in a "Z" fold and an address for a delivery of the mail piece may be printed where it will be visible through window 18 of window envelope form 10. (Those skilled in the art will recognize that text on sheets folded in "C" or "Z" folds must be printed in formats which are respectively inverted if both are to appear conventional to the recipient.)

The accumulator folder mechanism of FIGS. 7A and 7B also includes gate G2, which when activated, deflects sheets from buckle chute 112 so that they are passed on, unfolded, to guides 130. Gate G2 is activated so that envelope form 10 may be processed through assembly 106 without folding. Gate G2 is mounted on pivot 830 and connected by arm 832 to actuator 836 by slot 838 and pin 840. When solenoid 844 is energized actuator 836 retracts and Gate G2 pivots to a closed, deflecting position. (shown in phantom)

Figure 9:
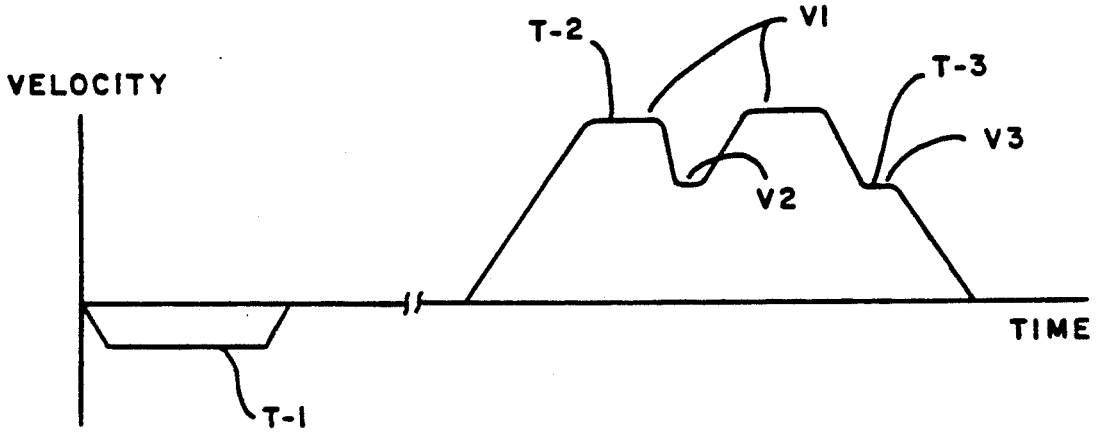
FIG. 9 shows a velocity profile for a mechanism in accordance with the subject invention.

FIG. 9 shows the velocity profile for accumulator folder assembly 106. During time T-1 assembly 106 may rotate in a reverse direction to prevent sheets from binding in the nip of rollers 300 and 302 as they are accumulated. Once any holding time has elapsed during time T-2 assembly 106 is ramped up to a predetermined operating velocity V1, which is preferably approximately 8 inches per second, until, as shown in FIG. 7A the leading edge of sheet S reaches stop 810 and buckles to be captured by fold roller pair 800 and 806. Since the accumulation may include more than the single sheet S motor Ml may be slowed then to velocity V2 to increase its torque to assure folding of the, possibly multiple, sheets without stalling. Assembly 106 then returns to its operating velocity and is then ramped down to a halt to await the next sheets. Preferably at least accumulator folder assembly 140, which folds the final accumulation, including envelope form 10 and any additional pre-printed sheets added along guides 144, will be so slowed during folding.

Assembly 106 is slowed to velocity V3 during the time T-4 in which sheets are handed-off for further processing, which helps to assure a smooth hand-off.

Appropriate velocities V2 and V3 may be easily determined by simple experimentation while the times are determined in a straight forward manner form the sheet and system dimensions and the velocities.

Assembly 140 operates in an similar manner, but is configured for a half fold (i.e. two thirds to one-thirds). Because of its vertical orientation and the possible thickness of the final accumulation buckle chute 160 is not completely open; idler roller 161 and a spring support (not shown) have been found to be useful to assure that the accumulation conforms to the curve of chute 160.

A prototype system, substantially as shown in FIG. 3 and including a mechanism in accordance with the subject invention has been developed and tested and is believed to have satisfactorily achieved the objects of the subject invention. The following parameters have been found acceptable in the prototype system.

A sheet and form are input from laser printers at a velocity of approximately 2 inches per second along guide 100.

The final accumulation of form 10 with printed and pre-printed sheets is transported through flap folder sealer 180 at a velocity of approximately 3 inches per second.

Accumulator folder assemblies 106 and 140 and all other urge rollers and roller pairs transport sheets and/or form 10 at 8 inches per second.

An input velocity of two inches per second matches the output laser printer 5, while the increase in velocity to eights inches per second of accumulator sheets with form 10, laterally align the final accumulation and fold it to one-third size (i.e. letter size). It is believed that the system speed can be increased to match higher speed printers with little effort.

The urge rollers apply a normal force in the range of two to five ounces. Lower levels of force are chosen where the sheet is urged over a longer distance, as the columnar stiffness of the sheet decreases with the length over which the load is applied.

The bearing surfaces of the urge rollers are micro-cellular urethane and have a coefficient of friction of from 1.0 to 1.4.

Buckle chutes, and the portions of guides supporting sheets in the nips of assemblies 106 and 140, have radii of curvature (not necessarily constant) of from 2 to 5 inches.

Those skilled in the art will readily appreciate that the system shown in FIG. 1 provides an almost limitless ability to produce mail pieces having a selected configuration. In the prototype system the allowable combinations are limited by the following rules:

1. Each feeder tray: T1, T2, T3, T4 will have homogeneous stock.
2. Each mail piece will include exactly one envelope.
3. Each mail piece will include at least one non-envelope.
4. Each mail piece having a window envelope, will include at least one printed sheet.
5. For each mail piece a feeder will supply no more than two one-thirds sized sheets.
6. Each mail piece will include no more than one BRE.
7. Because of the practical limitations on folding ability each mail piece will include no more than a total of three two-thirds size or three three-thirds size sheets.
8. Because of the practical limitations on envelope thickness each mail piece will be no more than twelve sheets thick, where BRE's are considered to be two sheets thick.

The above descriptions and examples have been provided by way of illustration only, and those skilled in the art will recognize numerous embodiments of the subject invention from the Detailed Description and attached drawings. Particularly, those skilled in the art will recognize that there is no reason why sheets of other fractional lengths less than 3/3's cannot be processed by the subject invention; though some otherwise possible accumulations may tend to jam when such sheets are included. Accordingly, limitations on the scope of these subject invention are to be found only in the claims set forth below.

What is claimed is:

1. An mechanism for accumulating and folding a plurality of sheets, comprising:

a) means for folding an accumulation of sheets, said folding means including means for activating said apparatus and a pair of intake rollers;

b) means for urging a plurality of sheets into the nip of said pair of intake rollers while said intake rollers are inoperative to form an accumulation having the leading edges of said sheets, aligned; and wherein, c) said activating means is responsive to formation of said accumulation to activate said apparatus to fold said accumulation.

2. A mechanism as described in claim 1 wherein said accumulation comprises at least a portion of a mail piece.

3. A mechanism as described in claim 2 further comprising means for selectively diverting said accumulation as it passes through said apparatus so that said accumulation is output from said mechanism without folding.

4. A mechanism as described in claim 2 wherein said folding means further comprises a buckle chute and a pair of fold rollers, said buckle chute causing said accumulation to be captured in the nip of said fold rollers so that said accumulation is folded along a predetermined line.

5. A mechanism as described in claim 4 further comprising means for selectively altering the operation of said buckle chute means so that said accumulation is folded along a second predetermined line.

6. A mechanism as described in claim 2 wherein said activating means activates said intake rollers in a first direction for a predetermined period as said accumulation is forming and then in the opposite direction to capture said accumulation.

7. A mechanism as described in claim 1 further comprising means for selectively diverting said accumulation as it passes through said apparatus so that said accumulation is output from said mechanism without folding.

8. A mechanism as described in claim 1 wherein said folding means further comprises a buckle chute and a pair of fold rollers, said buckle chute causing said accumulation to be captured in the nip of said fold rollers so that said accumulation is folded along a predetermined line.

9. A mechanism as described in claim 8 further comprising means for selectively altering the operation of said buckle chute means so that said accumulation is folded along a second predetermined line.

10. A mechanism as described in claim 1 wherein said activating means activates said intake rollers in a first direction for a predetermined period as said accumulation is forming and then in the opposite direction to capture said accumulation.

11. A mechanism for accumulating and folding a plurality of sheets, comprising:

a) a pair of in take rollers;

b) a guide for guiding sheets into the nip of said intake rollers c) an urge roller for urging said sheets along said guide into said nip to form an accumulation having the leading edges of said sheets aligned while said intake rollers are stopped or operating in a reverse direction.

d) a buckle chute aligned with said intake rollers to stop the leading edges of said accumulation after they have travelled a predetermined distance, whereby further driving by said intake rollers will cause said accumulation to buckle around a predetermined transverse line; and, e) a pair of fold rollers aligned to capture said accumulation as it buckles and fold said accumulation on said transverse line.

12. A mechanism as described in claim 11 further comprising a selectively operable gate mechanism for deflecting said accumulation past said buckle chute and directly into the nip of said fold rollers.

13. A mechanism as described in claim 11 further comprising a selectively operable stop for stopping said accumulation after it has travelled a second predetermined distance, whereby said accumulation is folded on a second predetermined transverse line.

14. A mechanism as described in claim 11 further comprising:

a) a second guide for guiding sheets into the nip of said intake roller; and, b) a second urge roller for urging said sheets into said nip.

15. A mechanism as described in claim 11 further comprising:

a) sensors for detecting the presence of said sheets on said guide;

b) a motor for activating said apparatus; and, c) a controller responsive to said sensors for controlling said motor to so that said intake rollers are inoperative to capture said sheets until said accumulation is formed and then to activate said apparatus to capture and fold said accumulation.

16. A mechanism as described in claim 11 further comprising means for increasing the columnar stiffness of said sheets, whereby buckling of said sheets as said accumulation is formed is avoided.

17. A mechanism for folding an accumulation of sheets, comprising:

a) a pair of intake rollers for capturing said accumulation;

b) a buckle chute for receiving said accumulation and causing said accumulation to buckle around a predetermined transverse line;

c) a pair of fold rollers for capturing said accumulation as it buckles and folding said accumulation on said transverse line;

d) motor means responsive to the passage of said accumulation through said apparatus for operating said apparatus at first speed until approximately the time when said fold rollers capture said accumulation and then operating said apparatus with increased torque.

18. A method for folding sheets comprising the steps of:

a) providing a folding apparatus, said folding apparatus including a pair of intake rollers;

b) forming an accumulation of sheets having the leading edges of said sheets aligned in the nip of said intake rollers; and c) then operating said folding apparatus to fold said accumulation.

19. A method as described in claim 18 comprising the further step of stiffening said sheets to avoid buckling of said sheets as said accumulation is formed.

20. A method as described in claim 18 wherein said sheets are urged into said nip.

21. An mechanism for accumulating and folding a plurality of sheets, comprising:

a) means for folding an accumulation of sheets, said folding means including means for activating said apparatus and a pair of intake rollers;

b) means for urging a plurality of sheets into the nip of said pair of intake rollers while said intake rollers are inoperative to capture said sheets, whereby said accumulation is formed in said nip; wherein, c) said activating means is responsive to formation of said accumulation to activate said apparatus to fold said accumulation; and wherein, d) said activating means activates said intake rollers in a first direction for a predetermined period as said accumulation is forming and then in the opposite direction to capture said accumulation.

22. A mechanism as described in claim 21 wherein said accumulation comprises at least a portion of a mail piece.

23. A mechanism for accumulating and folding a plurality of sheets, comprising:

a) a pair of intake rollers;

b) a guide for guiding sheets into the nip of said intake rollers;

c) an urge roller for urging said sheets along said guide into said nip to form an accumulation while said intake rollers are stopped or operating in a reverse direction;

d) a buckle chute aligned with said intake rollers to stop the leading edges of said accumulation after they have travelled a predetermined distance, whereby further driving by said intake rollers will cause said accumulation to buckle around a predetermined transverse line;

e) a pair of fold rollers aligned to capture said accumulation as it buckles and fold said accumulation on said transverse line;

f) sensors for detecting the presence of said sheets on said guide;

g) a motor for activating said apparatus; and, h) a controller responsive to said sensors for controlling said motor to so that said intake rollers are inoperative to capture said sheets until said accumulation is formed and then to activate said apparatus to capture and fold said accumulation.

24. A mechanism for accumulating and folding a plurality of sheets, comprising:

a) a pair of intake rollers;

b) a guide for guiding sheets into the nip of said intake rollers;

c) an urge roller for urging said sheets along said guide into said nip to form an accumulation while said intake rollers are stopped on operating in a reverse direction.

d) a buckle chute aligned with said intake rollers to stop the leading edges of said accumulation after they have travelled a predetermined distance, whereby further urging by said intake rollers will cause said accumulation to buckle around a predetermined transverse line;

e) a pair of fold rollers aligned to capture said accumulation as it buckles and fold said accumulation on said transverse line; and, f) means for increasing the columnar stiffness of said sheets, whereby buckling of said sheets as said accumulation is formed is avoided.

25. A method for folding sheets comprising the steps of:

a) providing a folding apparatus, said folding apparatus including a pair of intake rollers;

b) forming an accumulation of sheets in the nip of said intake rollers while stiffening said sheets to avoid buckling of said sheets as said accumulation is formed; and c) then operating said folding apparatus to fold said accumulation.

26. A method as described in claim 25 wherein said sheets are urged into said nip.

* * * * *